US011111109B2

(12) United States Patent
Cambruzzi et al.

(10) Patent No.: US 11,111,109 B2
(45) Date of Patent: Sep. 7, 2021

(54) METHOD AND MOUNTING DEVICE FOR CARRYING OUT AN INSTALLATION OPERATION IN AN ELEVATOR SHAFT

(71) Applicant: Inventio AG, Hergiswil (CH)

(72) Inventors: Andrea Cambruzzi, Zurich (CH); Philipp Zimmerli, Harkingen (CH); Raphael Bitzi, Lucerne (CH); Erich Butler, Ebikon (CH)

(73) Assignee: INVENTIO AG, Hergiswil NW (CH)

( * ) Notice: Subject to any disclaimer, the term of this patent is extended or adjusted under 35 U.S.C. 154(b) by 382 days.

(21) Appl. No.: 16/088,111

(22) PCT Filed: Mar. 28, 2017

(86) PCT No.: PCT/EP2017/057259

§ 371 (c)(1),
(2) Date: Sep. 25, 2018

(87) PCT Pub. No.: WO2017/167719

PCT Pub. Date: Oct. 5, 2017

(65) Prior Publication Data

US 2020/0299105 A1 Sep. 24, 2020

(30) Foreign Application Priority Data

Mar. 31, 2016 (EP) ..... 16163399

(51) Int. Cl.
*B66B 19/00* (2006.01)

(52) U.S. Cl.
CPC ..... *B66B 19/002* (2013.01); *B66B 19/00* (2013.01)

(58) Field of Classification Search
CPC ..... B66B 19/002; B66B 19/00; B66B 7/02; B66B 7/023
See application file for complete search history.

(56) References Cited

U.S. PATENT DOCUMENTS 9,751,728 B2 * 9/2017 Mertala ..... E04G 3/246
2011/0067252 A1 * 3/2011 Van Der Meijden .. G01C 15/10 33/404

(Continued)

FOREIGN PATENT DOCUMENTS

CN 103832903 A 6/2014
JP 04055276 A * 2/1992

(Continued)

*Primary Examiner* — Michael R Mansen
*Assistant Examiner* — Michelle M Lantrip
(74) *Attorney, Agent, or Firm* — William J. Clemens; Shumaker, Loop & Kendrick, LLP

(57) ABSTRACT

A method and a mounting device for carrying out an installation operation in an elevator shaft of an elevator system include introducing a first elongate reference element into the elevator shaft oriented in a main direction of extent of the elevator shaft. The mounting device is introduced into the elevator shaft, which mounting device has a carrier component and a mechatronic installation component held by the carrier component. The mounting device is displaced into a fixing position in the main direction of extent of the elevator shaft. The relative position of the carrier component of the mounting device is determined with respect to the first reference element in the fixing position with a sensor arranged on the installation component. The relative position of the first reference element is determined with respect to at least two different sensor positions and thus positions of the installation component.

13 Claims, 3 Drawing Sheets

(56) References Cited

U.S. PATENT DOCUMENTS

| | | | | |
|---|---|---|---|---|
| 2017/0001842 | A1* | 1/2017 | Puntener | B66B 19/002 |
| 2018/0208439 | A1* | 7/2018 | Studer | B66B 7/02 |
| 2019/0112159 | A1* | 4/2019 | Cambruzzi | B66B 19/007 |
| 2019/0367328 | A1* | 12/2019 | Cambruzzi | E21D 7/02 |
| 2020/0055709 | A1* | 2/2020 | Cambruzzi | G01B 5/25 |
| 2020/0377339 | A1* | 12/2020 | Cambruzzi | B66B 19/00 |

FOREIGN PATENT DOCUMENTS

| | | | | |
|---|---|---|---|---|
| JP | 04251084 | A | * | 9/1992 |
| JP | H05105362 | A | | 4/1993 |
| JP | H0640679 | A | | 2/1994 |
| JP | H08277076 | A | | 10/1996 |
| JP | 2004256216 | A | * | 9/2004 |

* cited by examiner 123, 124, 125, 223, 224
SENSOR POSITION

METHOD AND MOUNTING DEVICE FOR CARRYING OUT AN INSTALLATION OPERATION IN AN ELEVATOR SHAFT

FIELD

The invention relates to a method for carrying out an installation operation in an elevator shaft of an elevator system, and to a mounting device for carrying out an installation operation in an elevator shaft of an elevator system.

BACKGROUND

JPH08277076 describes an at least partially automated method for orienting guide rails in an elevator shaft of an elevator system. For this purpose, two elongate reference elements in the form of wires are introduced into the elevator shaft. A device for orienting the guide rails can be displaced inside the elevator shaft, in a main extension direction of the elevator shaft. The device comprises two detection elements that can identify the position of the wires and thus the positioning of the device relative to the wires. The detection elements are fixed on the device, and therefore the device must be arranged in a defined position relative to the wires, in a plane that is transverse to the main extension direction of the elevator shaft.

In contrast thereto, an object of the invention is in particular that of proposing a method and a mounting device for carrying out an installation operation in an elevator shaft of an elevator system which allows for a high degree of flexibility when implementing the installation operation, in particular when positioning the mounting device relative to the reference element.

SUMMARY

In the method according to the invention for carrying out an installation operation in an elevator shaft of an elevator system a first elongate reference element is introduced into the elevator shaft, which element is oriented in a main extension direction of the elevator shaft. Moreover, a mounting device is introduced into the elevator shaft, which device comprises a carrier component and a mechatronic installation component that is held by the carrier component. Said mounting device is displaced in the main extension direction of the elevator shaft into a fixing position.

According to the invention, the relative position of the carrier component of the mounting device, in the fixing position, is determined with respect to the first reference element, a sensor arranged on the installation component being used for this purpose. The relative position of the first reference element is determined with respect to at least two different sensor positions and thus positions of the installation component. The different sensor positions arise, for example, with respect to the carrier component that is fixed in the elevator shaft, or with respect to the first reference element. When determining the relative position of the first reference element with respect to a sensor position, it is possible to proceed both from the sensor position and from the reference element.

The steps mentioned are carried out in particular in the sequence described, but a different sequence is also conceivable.

In this case, an installation operation is to be understood as attaching or orienting a component, for example what is known as a rail clip lower part, in an elevator shaft.

The reference element is in particular flexible, for example formed as a plastics cord or as a metal wire. However, said element can also be rigid, for example formed as a plastic or metal rail. When the reference element is introduced into the elevator shaft said element is in particular also fixed in the elevator shaft. As a result, the position of the reference element with respect to the elevator shaft, and thus with respect to the walls of the elevator shaft, is known. The spacing of the reference element from the different walls of the elevator shaft, for example, is thus known. This information can be used when determining a mounting position of a mounting step to be carried out by the installation component. The reference element is oriented in the main extension direction of the elevator shaft, and thus extends primarily in the main extension direction, the main extension direction being understood as the direction in which an elevator car is moved in the fully mounted elevator system. The main extension direction thus extends in particular vertically, but can also extend so as to be inclined with respect to the vertical, or can extend horizontally. In this case, the reference element does not necessarily need to extend along a single straight line over its entire length. It is also possible for the course of the reference element to be composed of straight sections, the transition regions of which may also be rounded.

The carrier component of the mounting device can be designed in different ways. For example, the carrier component can be designed as a simple platform, rack, frame, cabin, or the like. Dimensions of the carrier component are in particular selected in such a way that the carrier component can easily be accommodated in the elevator shaft and displaced inside this elevator shaft in the main extension direction thereof. A mechanical design of the carrier component is selected in particular such that said component can reliably carry the mechatronic installation component held thereon and, if necessary, withstand the forces exerted by the installation component when carrying out a mounting step.

The installation component of the mounting device is intended to be mechatronic, i.e. it is intended to comprise cooperating mechanical, electronic and information technology elements or modules.

For example, the installation component may comprise a suitable mechanism in order to handle tools within a mounting step for example. In this case, the tools can be appropriately moved into the mounting position by the mechanism and/or appropriately guided during a mounting step. Alternatively, the installation component may also itself comprise a suitable mechanism that forms a tool. The mentioned tool may be designed as a drill or a screwdriver for example.

Electronic elements or modules of the mechatronic installation assembly component can serve, for example, to appropriately actuate or control mechanical elements or modules of the installation component. Such electronic elements or modules can therefore serve, for example, as a control means of the installation component. Further control means may also be provided which mutually exchange information, distribute control tasks and/or monitor one another. When a control means is mentioned in the following, this refers to one or more of said control means.

Furthermore, the installation component may comprise information technology elements or modules, by means of which it is possible to derive, for example, the position to which a tool should be moved and/or how the tool should be operated and/or guided there during a mounting step.

In this case, an interaction between the mechanical, electronic and information technology elements or modules takes place in particular in such a way that, within the context of the installation operation, at least one mounting step can be carried out by the mounting device in a partially or fully automatic manner.

In order to displace the mounting device inside the elevator shaft, in particular a displacement component is provided. For example, a drive premounted in the elevator shaft can be provided as a displacement component. Said drive may be intended only for displacing the installation component or may also be designed as a prime mover to be used later for the elevator system, by means of which an elevator car is to be moved in the fully installed state and which can be used during the preceding installation operation in order to displace the carrier component. The displacement component can be designed in different ways in order to be able to move the mounting device inside the elevator shaft.

For example, the displacement component can be fixed either on the carrier component of the mounting device or at a top stopping point of the elevator shaft and comprise a suspension element that can be subjected to tensile loading and is flexible, for example a cable, a chain or a belt, one end of which is held on the displacement component and the other end of which is fixed on the respective other element, i.e. at the top stopping point inside the elevator shaft and on the mounting device, respectively.

In the fixing position, the mounting device is fixed with respect to the elevator shaft in particular in such a way as to prevent the carrier component of the mounting device from being able to move inside the elevator shaft in a direction transversely to the main extension direction during a mounting step in which the installation component operates and exerts transverse forces, for example, on the carrier component. For this purpose, the mounting device may in particular comprise a fixing component that can for example be designed in such a way that it is supported laterally on the walls of the elevator shaft or that it is press-fitted in such a way that the carrier component can no longer move relative to the walls in the horizontal direction. To this end, the fixing component can have, for example, suitable supports, props, levers, or the like.

The relative position of the carrier component of the mounting device, in the fixing position, with respect to the first reference element is determined in particular by means of a sensor arranged on the installation component being moved into two different positions close to the first reference element, and the spacing between the sensor and the reference element being determined in each case. In this case, the two different positions of the sensor are in particular mutually spaced in the main extension direction and are known to the control means. The relative position of the carrier component with respect to the first reference element can be determined from the known positions of the sensor and the spacings between the sensor and the reference element. Since the position and the course of the first reference element in the elevator shaft are also known, the relative position of the carrier component in the elevator shaft can thus be determined. In this case, the relative position of the carrier component of the mounting device is understood in particular to be the orientation thereof relative to the main extension direction, i.e. the tilt and/or rotation thereof with respect to the main extension direction. It is also possible for the sensor to be positioned so as to be at a defined spacing from the first reference element, and for this position of the sensor to then be used as the basis. It is also possible for the position of the carrier component with respect to the walls of the elevator shaft, in the fixing position, to be determined by means of the sensor. For this purpose, the sensor can for example be moved into one or in particular a plurality of positions relative to one or more walls, and the spacing from the corresponding wall can be measured in each case. It is also possible for the sensor to move continuously along a wall and for the spacing from the wall to be constantly measured. As a result, the course of the walls in the region of the fixing position can be determined very precisely.

It is furthermore possible for the sensor to be moved into four positions and for the spacing from the reference element to be determined in each position of the sensor. In this case, two positions in each case are in the same location in the main extension direction of the elevator shaft, and the calculated location with respect to the reference element in these two positions is averaged. As a result, negative effects of oscillations of the reference element which may occur are compensated at least in part or completely. Thus, in general terms, two measurements in different sensor positions are carried out in each case at each position in the main extension direction.

The mentioned sensor can in particular determine the position of the first reference element, for example the spacing between the sensor and the first reference element, in a contactless manner. The sensor can for example be designed as a laser scanner, a laser or ultrasonic rangefinder or as a 3D digital camera comprising an associated evaluation unit. The sensor is in particular fixed on the installation component. Said sensor is in particular arranged on a part of the installation component that is movable with respect to the carrier component, and specifically is arranged as close as possible to an outer end of the installation component, for example on an unsupported end of an industrial robot. The installation component thus does not have to receive the sensor before each use, with the result that it is possible to carry out an installation operation in a particularly time-saving manner. However, if necessary the installation component can for example also receive the sensor from a magazine and place it back in the magazine after use.

The position of the carrier component in the main extension direction is in particular determined without using the first reference element. For this purpose, a positioning system can be used for example, by means of which it is possible to determine the position of an elevator car in the main extension direction in the fully installed state. It is also possible for a spacing from an end of the elevator shaft or for a door opening in the elevator shaft to be determined by means of a suitable rangefinder, for example based on an ultrasonic or laser measuring technique. A further possibility is for the position in the main extension direction to be determined proceeding from a known position, by means of monitoring activity of the displacement component. Moreover, there are numerous further possibilities for determining the position of the carrier component in the main extension direction.

Since the control means now knows the position of the carrier component of the mounting device in the elevator shaft, a mounting position of a mounting step to be carried out by the installation component can be determined. For example, the control means can determine the position at which a rail clip lower part is to be attached to a wall of the elevator shaft. The control means can for example determine the position of the drill holes required therefor and make the holes in the wall of the elevator shaft using a drill received by the installation component. Furthermore, a plurality of other mounting steps, such as screwing a screw into a drill hole or attaching a rail clip lower part, are possible.

In an embodiment of the invention, a signal of an acceleration sensor arranged on the mounting device can be used to determine the fixing position, the acceleration sensor in particular being arranged on the carrier component. It is thus possible to determine the position of the mounting device with respect to the perpendicular in a simple manner. It is thus possible, for example, to determine a rotation of the mounting device with respect to the main extension direction using the mentioned sensor and the first reference element, and to determine a tilt of the mounting device with respect to the vertical using the acceleration sensor. The fixing position can thus be determined using just one reference element, which makes the determination particularly simple and cost-effective.

It is likewise possible to use an angle sensor to determine the angle of the carrier component with respect to the perpendicular.

The acceleration sensor or the angle sensor can also be used for checking the position determination by means of the sensor and the first reference element. This allows for particularly precise determination of the fixing position.

In an embodiment of the invention, a second elongate reference element is introduced into the elevator shaft, which element is also oriented in the main extension direction of the elevator shaft. The second reference element is in particular arranged so as to be in parallel with the first reference element. The relative position of the mounting device, in the fixing position, with respect to the second reference element is also determined using the sensor arranged on the installation component. Using two reference elements makes it possible to determine the fixing position particularly precisely and in particular without using an acceleration sensor. Detecting at least three points (two that are spaced apart in the main extension direction on the first reference element and one on the second reference element) makes it possible to determine the plane that is spanned by the two reference elements and thus to determine the orientation of the mounting device, in the fixing position, relative to said plane. The position of the mounting device, in the fixing position, with respect to the elevator shaft is thus conclusively known. This embodiment of the invention thus allows for particularly precise determination of the fixing position.

In an embodiment of the invention, the installation component is held by the carrier component by means of a retaining device, and the relative position of the retaining device with respect to the first and/or second reference element is determined. The retaining device thus serves as a base for the installation component, and in particular forms the origin of a coordinate system of the installation component. The relative position of the origin of the coordinate system is thus determined by means of the determination of the relative position of the retaining device, allowing for particularly precise positioning of the installation component. Moreover, it is thus possible to particularly easily carry out a transformation between different coordinate systems, which may be required.

In an embodiment of the invention, in order to set the fixing position, the carrier component is fixed directly to at least one wall of the elevator shaft, in particular press-fitted directly to walls of the elevator shaft. Fixing therefore occurs directly to the wall or the walls, without additional fixing means being interposed. As a result, no additional fixing means are required, making application of the method particularly simple and cost-effective. In addition, the press-fitting to the shaft walls can achieve a particularly reliable and stable fixing position.

In an embodiment of the invention, a first common mounting plate is fastened in the elevator shaft, to which plate first ends of the first and second reference element are fastened. It is thus possible to particularly easily specify and adhere to a defined mutual spacing between the two first ends of the reference elements. Furthermore, the two first ends of the reference elements can be fixed in the elevator shaft in a particularly simple manner by means of the fastening of the mounting plate.

In particular, a second common mounting plate is also fastened in the elevator shaft, to which plate second ends of the first and second reference element are fastened. The two reference elements are in particular at the same mutual spacing on both mounting plates, and this therefore particularly easily ensures that both reference elements extend in parallel with one another over the entire length thereof.

The first mounting plate may for example be fastened to the floor of a bottom door opening of the elevator shaft, and the second mounting plate may for example be fastened to the floor or to the ceiling of a top door opening. It is thus possible to ensure, in a simple manner, that the reference elements extend through the entire part of the elevator shaft that is of importance for the mounting device. Mounting on the door openings is also particularly simple and safe, since it is not necessary to enter the elevator shaft for this purpose, but instead mounting is possible from the floors assigned to the door openings.

In an embodiment of the invention, the first and/or second reference element is fixed, between the ends thereof, to the elevator shaft in order to reduce oscillations. In particular in the case of high elevator shafts, and thus long reference elements, there may be a risk that the reference elements are excited so as to oscillate, which may make the determination of the fixing position of the mounting device imprecise. One or more fixings of the reference element, between the two ends thereof, to the wall of the elevator shaft for example, can prevent or at least reduce oscillation of this kind. This allows for particularly precise determination of the fixing position, in particular even in high elevator shafts.

The object set out above is also achieved by a mounting device for carrying out an installation operation in an elevator shaft of an elevator system, which device comprises:

- a carrier component and a mechatronic installation component that is held by the carrier component, the carrier component being designed to be displaced in a main extension direction of the elevator shaft and to be fixed in a fixing position, and
- a control means which is intended for determining a relative position of the mounting device, in the fixing position, with respect to a first elongate reference element in the elevator shaft, which element is oriented in a main extension direction of the elevator shaft, by using a sensor arranged on the installation component, determining the relative position of the first reference element with respect to at least two different sensor positions and thus positions of the installation component, and determining the fixing position in the elevator shaft on the basis of the relative position of the mounting device with respect to the first reference element.

Further advantages, features and details of the invention are set out in the following description of embodiments and in the drawings, in which identical or functionally identical elements are denoted with the same reference signs.

DETAILED DESCRIPTION

Figure 1:
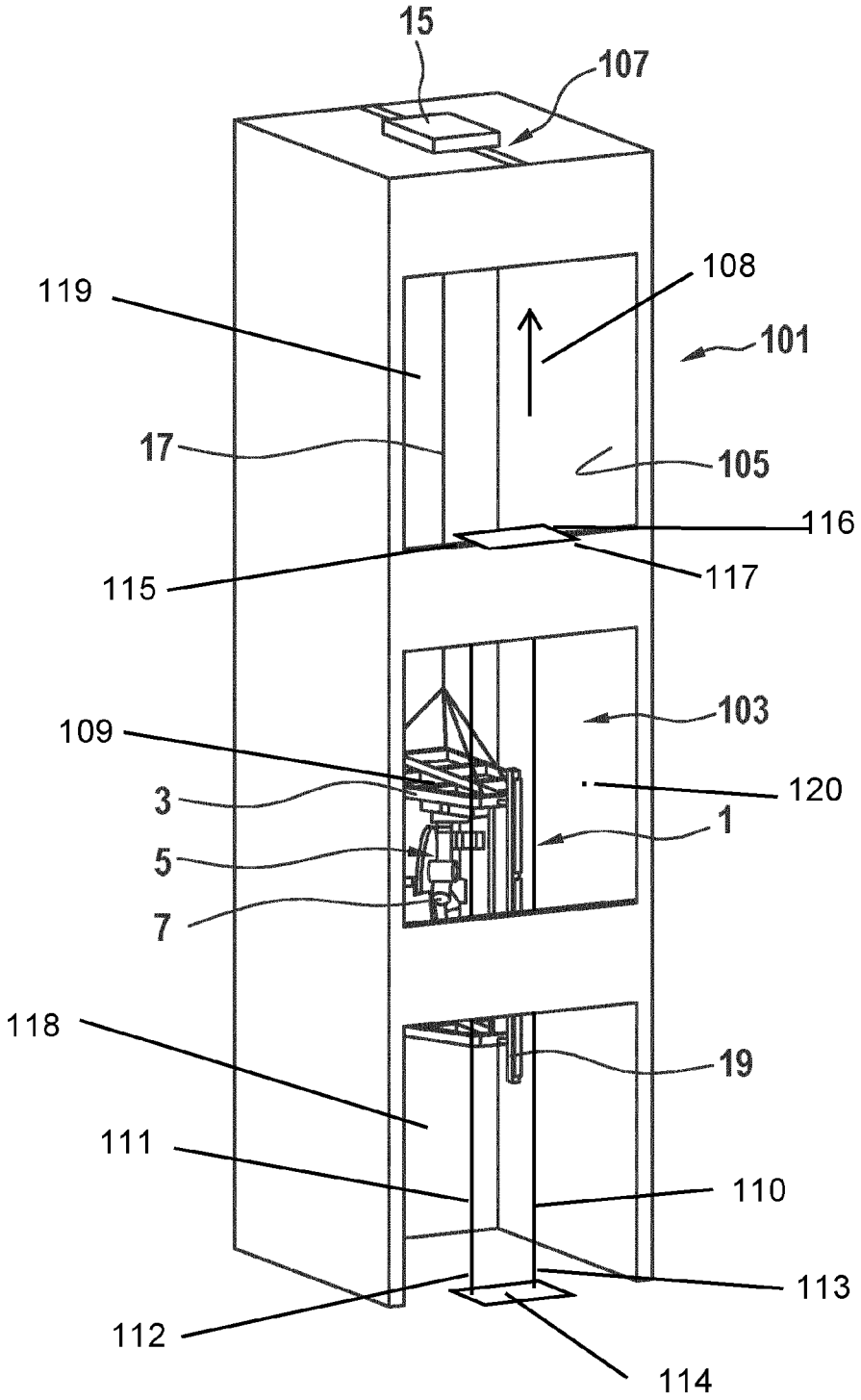
FIG. 1 is a perspective view of an elevator shaft of an elevator system comprising a mounting device according to an embodiment of the present invention received therein.

FIG. 1 illustrates an elevator shaft 103 of an elevator system 101, in which a mounting device 1 according to an embodiment of the present invention is arranged. The mounting device 1 comprises a carrier component 3 and a mechatronic installation component 5. The carrier component 3 is designed as a frame on which the mechatronic installation component 5 is mounted. Said frame has dimensions that permit the carrier component 3 to be displaced within the elevator shaft 103 in a main extension direction 108 of the elevator shaft 103, and thus in this case vertically, i.e. for example to move to different vertical positions on different floors within a building. In the example shown, the mechatronic installation component 5 is designed as an industrial robot 7 that is attached to the frame of the carrier component 3 by means of a retaining device 109 so as to be suspended downwardly. In this case, one arm of the industrial robot 7 may be moved relative to the carrier component 3 and, for example, displaced towards a wall 105 of the elevator shaft 103.

The carrier component 3 is connected, via a steel cable acting as a suspension element 17, to a displacement component 15 in the form of a motor-driven cable winch that is attached at the top of the elevator shaft 103 to a stopping point 107 on the ceiling of the elevator shaft 103. By means of the displacement component 15, the mounting device 1 can be moved vertically within the elevator shaft 103 along the main extension direction 108, i.e. vertically across an entire length of the elevator shaft 103.

Furthermore, the assembly device 1 comprises a fixing component 19, by means of which the carrier component 3 can be fixed within the elevator shaft 103 in the lateral direction, i.e. in the horizontal direction. The carrier component 3 is thus moved into a fixing position in which the carrier component 3 is shown in FIG. 1. The fixing component 19 on the front side of the carrier component 3 and/or the prop (not shown) on a rear side of the carrier component 3, can be displaced outward to the front or the back for this purpose, and thus press-fit the carrier component 3 between walls 105 of the elevator shaft 103. In this case, the fixing component 19 and/or the prop can be anchored outwards, for example by means of hydraulics or the like, in order to fix the carrier component 3 in the elevator shaft 103 in the horizontal direction.

Two elongate reference elements 110 and 111 in the form of cords extend within the elevator shaft 103, which elements are introduced into the elevator shaft 103 before the mounting device 1 is introduced. First, lower ends 112, 113 of the reference elements 110, 111 are fastened to a first, lower mounting plate 114, and second, upper ends 115, 116 of the reference elements 110, 111 are fastened to a second, upper mounting plate 117. The two reference elements 110, 111 are at the same mutual spacing on both mounting plates 114, 117, such that they extend in parallel with one another. The lower mounting plate 114 is fastened to the floor of a bottom door opening 118, and the upper mounting plate 117 is fastened to the floor of a top door opening 119, such that the reference elements 110, 111 extend in the main extension direction 108 within the elevator shaft 103. The position of the reference elements 110, 111 with respect to the walls 105 of the elevator shaft 103 is thus also known.

Figure 2:
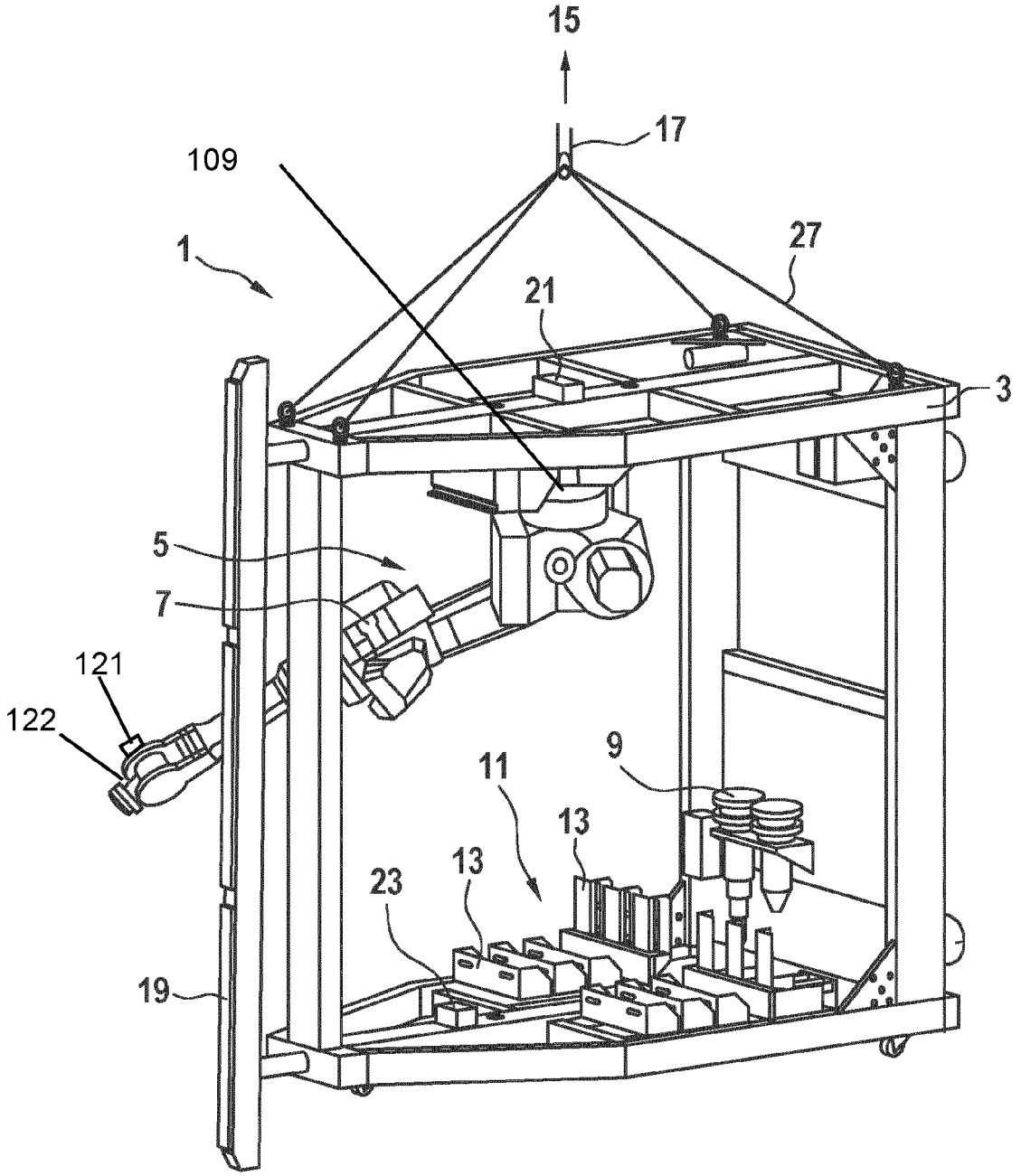
FIG. 2 is a perspective view of a mounting device according to an embodiment of the present invention.

FIG. 2 is an enlarged view of a mounting device 1 according to an embodiment of the present invention.

The carrier component 3 is formed as a cage-like frame, in which a plurality of horizontally and vertically extending bars form a mechanically robust structure.

Retaining cables 27 are attached to the top of the cage-like carrier component 3, which cables can be connected to the suspension element 17. By displacing the suspension element 17 within the elevator shaft 103, i.e., for example, by winding and unwinding the flexible suspension element 17 on the cable winch of the displacement component 15, the carrier component 3 can thus be displaced within the elevator shaft 103 in the main extension direction 108 in a suspended manner, and therefore displaced vertically.

The fixing component 19 is provided next to the carrier component 3. In the example shown, the fixing component 19 is formed having an elongate bar extending in the vertical direction, which can be displaced in the horizontal direction with respect to the frame of the carrier component 3. For this purpose, the bar may be attached to the carrier component 3 for example by means of a lockable hydraulic cylinder or a self-locking motor spindle. If the bar of the fixing component 19 is displaced away from the frame of the carrier component 3, said bar moves laterally towards one of the walls 105 of the elevator shaft 103. Alternatively or additionally, props can be displaced backwards on the rear of the carrier component 3 in order to anchor the carrier component 3 in the elevator shaft 103. In this way, the carrier component 3 can be press-fitted within the elevator shaft 103 and can thereby for example fix the carrier component 3 within the elevator shaft 103 in the lateral direction, and thus in the fixing position, when carrying out a mounting step. Forces which are applied to the carrier component 3 can be transferred in this state to the walls 105 of the elevator shaft 103, preferably without the carrier component 3 being able to be displaced within the elevator shaft 103 or starting to vibrate in the process.

In the embodiment shown, the mechatronic installation component 5 is formed using an industrial robot 7. It is noted, however, that the mechatronic installation component 5 can also be implemented in other ways, for example using differently designed actuators, manipulators, effectors, etc. In particular, the installation component could comprise mechatronics or robotics specially adapted for use for an installation operation within an elevator shaft 103 of an elevator system 1.

In the example shown, the industrial robot 7 is equipped with a plurality robotic arms that are pivotable about pivot axes. The industrial robots may, for example, have at least six degrees of freedom, i.e. a mounting tool 9 guided by the industrial robot 7 can be moved with six degrees of freedom, i.e., for example, with three degrees of rotational freedom and three degrees of translational freedom. The industrial robot can, for example, be designed as a vertical buckling arm robot, a horizontal buckling arm robot, a SCARA robot or a cartesian robot, or as a portal robot.

The unsupported end of the robot can be coupled to different mounting tools or sensors 9. The mounting tools or sensors 9 may differ in their design and their intended use. The mounting tools or sensors 9 can be held on the carrier component 3 in such a way that the unsupported end of the industrial robot 7 can be brought towards said tools or sensors and be coupled to one thereof.

One of the mounting tools 9 can be designed as a drilling tool similar to a drilling machine. By coupling of the industrial robot 7 to such a drilling tool, the installation component 5 can be designed in such a way that it allows for an at least partially automated controlled drilling of holes, for example in one of the walls 105 of the elevator shaft 103. In this case, the drilling tool may be moved and handled by the industrial robot 7 in such a way that the drilling tool, using a drill, drills holes at a specified position, i.e. a mounting position 120 in FIG. 1, for example in the concrete of the wall 105 of the elevator shaft 103, into which holes fastening screws, for example, can later be screwed in order to fix fastening elements.

Another mounting tool 9 can be designed as a screwing device for screwing screws into previously drilled holes in a wall 105 of the elevator shaft 103 in an at least partially automatic manner.

A magazine component 11 can furthermore be provided on the carrier component 3. The magazine component 11 can serve to store components 13 to be installed and to provide the installation component 5.

In the example shown, the industrial robot 7 can for example automatically grasp a fastening screw from the magazine component 11 and for example screw it into previously drilled fastening holes in the wall 105 using a mounting tool 9 designed as a screwing device.

In the example shown, it can be seen that, by using the mounting device 1, mounting steps of an installation operation in which components 13 are mounted on a wall 105 can be carried out in a completely or at least partially automated manner, in that the installation component 5 first drills holes into the wall 105 and then screws fastening screws into said holes.

In order for it to be possible to determine the position of the carrier component 3 of the mounting device 1 within the elevator shaft 103, the mounting device 1 comprises a control means (electronic control) 23 that is arranged in the lower region of the carrier component 3. The control means 23 is in signal communication with a sensor 121 that is arranged on the unsupported end 122 of the industrial robot 7. The sensor 121 is designed as a laser scanner for example, by means of which a spacing from any desired object can be determined. The control means 23 can thus in particular determine the spacing between the sensor 121 and one of the two reference elements 110, 111. Since the control means 23 knows the position of the industrial robot 7, and thus also the position of the sensor 121, with respect to the retaining device 109 and thus with respect to the carrier component 3, said control means can determine therefrom the position of the carrier component 3 with respect to the reference elements 110, 111, and since the position of the reference elements 110, 111 with respect to the elevator shaft 103 is also known, said control means can thus determine the position of the carrier component 3 in the elevator shaft 103.

Figure 3:
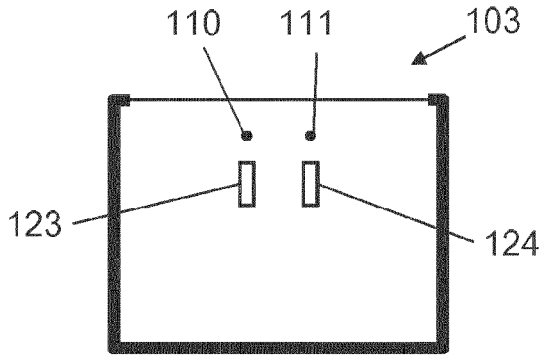
FIG. 3 is a simplified view from above into an elevator shaft comprising two reference elements.
Figure 4:
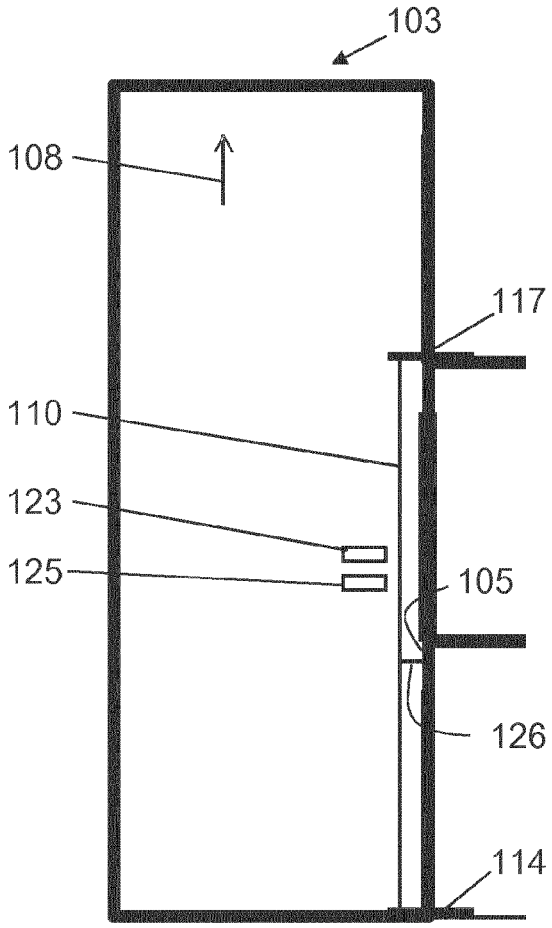
FIG. 4 is a simplified view from the side into an elevator shaft comprising two reference elements.

The procedure when determining the position of the carrier component 3 with respect to the reference elements 110, 111 is explained in greater detail with reference to FIGS. 3 and 4. FIG. 3 is a view into the elevator shaft 103 from above, only the elevator shaft 103 itself, the two mutually parallel reference elements 110, 111, and two sensor positions 123, 124 being shown. The industrial robot 7, on which the sensor 121 is arranged, is not shown for reasons of clarity. FIG. 4 is a view into the elevator shaft 103 from the side, only the elevator shaft 103 itself, the reference element 110, and two sensor positions 123, 125 being shown.

In order to determine the position of the carrier component 3 with respect to the reference elements 110, 111, the control means 23 initially actuates the industrial robot 7 such that the sensor 121 assumes the first sensor position 123 and then determines the spacing between the sensor 121 and the first reference element 110. Subsequently, the sensor 121 is moved, by means of the industrial robot 7, into the second sensor position 125 which is located below the first sensor position 123, and the spacing between the sensor 121 and the first reference element 110 is determined again. Subsequently, the sensor 121 is moved into the sensor position 124 which is in particular located at the same height as the first sensor position 123, and the spacing between the sensor 121 and the second reference element 111 is determined. Three points on the two reference elements 110, 111 are thus detected, and the control means 23 can determine therefrom the plane spanned by the two reference elements 110, 111 and thus the orientation of the carrier component 3, in the fixing position, relative to said plane. It is also possible for the sensor 121 to be moved into a total of six sensor positions, two of which in each case are in the same location in the main extension direction 108 of the elevator shaft 103. The results of the measurements of the points having the same position in the main extension direction are averaged.

In addition, the position of the carrier component 3 with respect to the walls 105 of the elevator shaft 103, in the fixing position, can be determined by means of the sensor 121.

The position of the carrier component 3 in the main extension direction 108 is determined proceeding from a position at the very bottom of the elevator shaft 103, by means of adding together the displacements of the carrier component 3 carried out by the displacement component 15. For this purpose, a relative position measuring system (not shown) is arranged on the displacement component 15. The position in the main extension direction 108 can also be determined in another manner, for example by means of measuring the spacing between the carrier component and an end of the elevator shaft.

On the basis of the position of the carrier component 3 with respect to the reference elements 110, 111, the known position of the reference elements 110, 111 with respect to the walls 105 of the elevator shaft 103, and the position in the main extension direction 108, the control means 23 can determine a mounting position 120 (see FIG. 1) of a mounting step to be carried out by the installation component 5. The industrial robot 7 can subsequently receive the tool 9 suitable for the mounting step, for example a drill, and carry out the mounting step, for example drilling a hole in the wall 105 of the elevator shaft 103.

FIG. 4 furthermore shows a fixing 126 of the reference element 110, which fixing is arranged between the first, lower mounting plate 114 and the second, upper mounting plate 117. The reference element 110 is fixed to the elevator shaft 103 by means of the fixing 126, as a result of which oscillation of the reference element 110 is prevented. The fixing 126 is designed as a rod that is connected to the reference element 110 at one end and to the wall 105 of the elevator shaft 103 at the other end. Other possible embodiments of the fixing are in addition conceivable. In particular in the case of high elevator shafts, it may be necessary for the reference element not to extend along a single straight line over the entire length thereof, but instead for the course of the reference element to be composed of straight sections. In this case, the fixing may define end points of individual straight sections.

The sensor for determining the spacing from one of the two reference elements 110, 111 does not need to be fixed on the industrial robot 7. It is also possible for the sensor, just like the mounting tool 9, to be received only when it is needed. In this case, the sensor, just like the mounting tool 9, is arranged on the carrier component.

Figure 5:
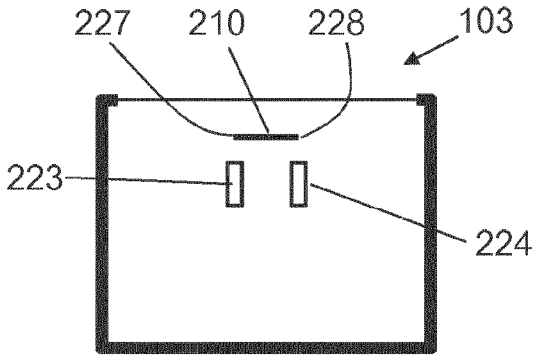
FIG. 5 is a simplified view from above into an elevator shaft comprising one reference element.

FIG. 5 is a view from above into an elevator shaft comprising just one reference element 210. In this case, the reference element 210 is designed as a rail. In addition, sensor positions 223, 224 are shown, from which the spacing from the two different edges 227, 228 of the reference element 210 is determined. As a result, a rotation of the carrier component 3 with respect to the reference element 210 can be determined. A tilt of the carrier component 3 with respect to the vertical is determined by means of an acceleration sensor 21 that is arranged on the carrier component 3, in the vicinity of the retaining device 109 for the installation component 5.

Finally, it should be noted that terms such as "comprising" and the like do not preclude other elements or steps, and terms such as "a" or "one" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for performing an installation operation in an elevator shaft of an elevator system comprising the following steps:

introducing an elongate first reference element into the elevator shaft, the first reference element being oriented in a main extension direction of the elevator shaft;

introducing a mounting device into the elevator shaft, the mounting device including a carrier component and a mechatronic installation component that is held by the carrier component;

displacing the mounting device in the main extension direction into a fixing position in the elevator shaft;

determining a relative position of the carrier component, in the fixing position, with respect to the first reference element using a sensor arranged on the installation component, the relative position being determined with respect to at least two different sensor positions of the sensor corresponding to two different positions of the installation component mutually spaced in the main extension direction;

determining the fixing position of the mounting device in the elevator shaft based on the relative position of the carrier component of the mounting device with respect to the first reference element;

determining a mounting position of a mounting step to be carried out by the installation component; and carrying out the mounting step.

2. The method according to claim 1 wherein the sensor is fixed on the installation component.

3. The method according to claim 1 including using a signal generated by an acceleration sensor arranged on the mounting device to determine the fixing position.

4. The method according to claim 1 including introducing an elongate second reference element into the elevator shaft, the second reference element being oriented in the main extension direction of the elevator shaft, and determining a relative position of the mounting device, in the fixing position, with respect to the second reference element using the sensor arranged on the installation component.

5. The method according to claim 4 wherein the installation component is held by the carrier component by a retaining device, and a relative position of the retaining device with respect to at least one of the first reference element and the second reference element is determined.

6. The method according to claim 1 wherein the installation component is held by the carrier component by a retaining device, and a relative position of the retaining device with respect to the first reference element is determined.

7. The method according to claim 1 including, in order to set the fixing position, fixing the carrier component directly to at least one wall of the elevator shaft.

8. The method according to claim 1 including, in order to set the fixing position, press-fitting the carrier component directly to walls of the elevator shaft.

9. The method according to claim 1 including introducing an elongate second reference element into the elevator shaft, the second reference element being oriented in the main extension direction of the elevator shaft, fastening a first mounting plate in the elevator shaft, and fastening first ends of the first and second reference elements to the first mounting plate.

10. The method according to claim 9 including fastening a second mounting plate in the elevator shaft and fastening second ends of the first and second reference elements to the second mounting plate.

11. The method according to claim 1 including fixing ends of the first reference element to the elevator shaft to reduce oscillations of the first reference element.

12. The method according to claim 1 including introducing an elongate second reference element into the elevator shaft, the second reference element being oriented in the main extension direction of the elevator shaft, and fixing ends of the second reference element to the elevator shaft to reduce oscillations of the second reference element.

13. A mounting device for carrying out an installation operation in an elevator shaft of an elevator system comprising:

a carrier component and a mechatronic installation component held by the carrier component, the carrier component being displaceable in a main extension direction of the elevator shaft and adapted to be selectively fixed in a fixing position in the elevator shaft;

an electronic control for determining a relative position of the mounting device, in the fixing position, with respect to an elongate first reference element in the elevator shaft, the first reference element being oriented in the main extension direction, using a sensor arranged on the installation component;

wherein the electronic control determines a relative position of the first reference element with respect to at least two different sensor positions of the sensor corresponding to two different positions of the installation component mutually spaced in the main extension direction; and determining the fixing position in the elevator shaft based upon the relative position of the mounting device with respect to the first reference element.

* * * * *